US009677427B2

(12) United States Patent
Synnott

(10) Patent No.: US 9,677,427 B2
(45) Date of Patent: Jun. 13, 2017

(54) AXIAL RETAINING RING FOR TURBINE VANES

(71) Applicant: PRATT & WHITNEY CANADA CORP., Longueuil (CA)

(72) Inventor: Remy Synnott, St Jean-sur-Richelieu (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 369 days.

(21) Appl. No.: 14/324,107

(22) Filed: Jul. 4, 2014

(65) Prior Publication Data

US 2016/0003102 A1 Jan. 7, 2016

(51) Int. Cl.

| | |
|---|---|
| ***F01D 25/24*** | (2006.01) |
| *F01D 9/04* | (2006.01) |
| *F01D 11/00* | (2006.01) |

(52) U.S. Cl.

CPC ..... *F01D 25/246* (2013.01); *F01D 9/041* (2013.01); *F01D 11/005* (2013.01); *F05D 2230/237* (2013.01); *F05D 2230/64* (2013.01); *F05D 2260/30* (2013.01)

(58) Field of Classification Search

CPC .... F01D 25/243; F01D 25/246; F01D 25/265; F01D 25/28; F01D 25/285; F01D 9/04; F01D 9/042; F01D 11/005; F05D 2230/237; F05D 2230/67; F05D 2260/30

See application file for complete search history.

(56) References Cited

U.S. PATENT DOCUMENTS

| | | | | |
|---|---|---|---|---|
| 4,981,390 | A * | 1/1991 | Cramer, Jr. ..... | F16D 1/0835 403/355 |
| 7,594,792 | B2 | 9/2009 | Audeon et al. | |
| 8,308,428 | B2 * | 11/2012 | Bridges, Jr. ..... | F01D 9/041 277/630 |
| 8,596,969 | B2 | 12/2013 | Chuong et al. | |
| 2005/0269339 | A1 * | 12/2005 | Ciccone ..... | B65D 43/0258 220/795 |

(Continued)

FOREIGN PATENT DOCUMENTS

| | | |
|---|---|---|
| JP | 2003185140 | 7/2003 |

*Primary Examiner* — Dwayne J White
*Assistant Examiner* — Sang K Kim
(74) *Attorney, Agent, or Firm* — Norton Rose Fulbright Canada LLP

(57) ABSTRACT

A gas turbine engine is described which has first and second turbine vane assemblies with multiple turbine vanes within respective first and second circumferential outer shrouds. The first outer shroud has a first radially extending flange and the second outer shroud has a second radially extending flange. The radially extending first and second flanges each defining an upstream mating surface and a downstream mating surface relative to a direction of air flow through the engine in use. The downstream mating surface of the first flange mates with the upstream mating surface of the second flange. An axial retaining ring axially retains together the first and second flanges, and has an annular body extending between an upstream portion of the body abutted against the upstream mating surface of the first flange and a downstream portion of the body abutted against the downstream mating surface of the second flange.

20 Claims, 7 Drawing Sheets

(56) References Cited

U.S. PATENT DOCUMENTS

| | | | | |
|---|---|---|---|---|
| 2006/0239814 | A1* | 10/2006 | Uwami | F01D 11/008 415/134 |
| 2009/0010755 | A1* | 1/2009 | Keller | F01D 21/045 415/197 |
| 2009/0053042 | A1* | 2/2009 | Wilson | F01D 11/20 415/134 |
| 2010/0247298 | A1* | 9/2010 | Nakamura | F01D 11/18 415/173.1 |
| 2012/0163964 | A1 | 6/2012 | Chuong et al. | |
| 2013/0177411 | A1* | 7/2013 | Weber | F01D 11/001 415/209.3 |
| 2014/0341728 | A1* | 11/2014 | Cloarec | F01D 25/246 415/207 |
| 2015/0118035 | A1* | 4/2015 | Gendraud | F01D 9/041 415/191 |
| 2015/0226124 | A1* | 8/2015 | Tsutsumi | F01D 25/246 415/193 |
| 2015/0252687 | A1* | 9/2015 | Arnould | F01D 9/042 416/95 |
| 2015/0267547 | A1* | 9/2015 | Guemmer | F01D 9/041 415/209.1 |

* cited by examiner

AXIAL RETAINING RING FOR TURBINE VANES

TECHNICAL FIELD

The application relates generally to gas turbine engines and, more particularly, to turbine sections of gas turbine engines.

BACKGROUND OF THE ART

For gas turbine engines designed to operate in a vertical orientation, such as those used in aircraft referred to as "tilt rotors", some components of the gas turbine engine which are originally designed to work in an ordinary, horizontal attitude may shift axially rearward, relative to the engine centreline, due to gravity when the engine is tilted upward into a vertical orientation for vertical flight. Such components may therefore not be suitable for gas turbines operating at varying attitudes.

SUMMARY

In one aspect, there is provided a gas turbine engine having a center axis of rotation, the engine comprising: first and second turbine vane assemblies having multiple turbine vanes within respective first and second circumferential outer shrouds, the first outer shroud having a first radially extending flange and the second outer shroud having a second radially extending flange, the radially extending first and second flanges each defining an upstream mating surface and a downstream mating surface relative to a direction of air flow through the engine in use, the downstream mating surface of the first flange mating with the upstream mating surface of the second flange; and an axial retaining ring axially retaining together the first and second flanges, the axial retaining ring having an annular body extending between an upstream portion of the body abutted against the upstream mating surface of the first flange and a downstream portion of the body abutted against the downstream mating surface of the second flange.

In another aspect, there is provided an axial retaining ring for axially retaining together first and second turbine vane assemblies of a gas turbine engine having multiple turbine vanes within respective first and second circumferential outer shrouds, the first shroud having a first radially extending flange and a second shroud having a second radially extending flange, the radially extending first and second flanges each defining an upstream mating surface and a downstream mating surface relative to a direction of air flow through the engine in use, the axial retaining ring comprising an annular body defining a center body axis and extending between an upstream portion of the body abutted against the upstream mating surface of the first flange and a downstream portion of the body abutted against the downstream mating surface of the second flange upon the body mounting about abutting downstream and upstream mating surfaces of the first and second flanges, respectively.

In a further aspect, there is provided a method for securing together adjacent first and second turbine vane assemblies of a gas turbine engine having a center axis, each turbine vane assembly having a radially extending, arcuate mating flange defining an upstream mating surface and a downstream mating surface, the method comprising: abutting the downstream mating surface of the first turbine vane assembly against the upstream mating surface of the second turbine assembly; and axially securing the abutted mating surfaces of the first and second turbine vane assemblies with an axial retaining ring, the axial retaining ring axially retaining the mating flanges of the first and second turbine vane assemblies together while allowing thermal growth therebetween.

DESCRIPTION OF THE DRAWINGS

Reference is now made to the accompanying figures in which.

DETAILED DESCRIPTION

Figure 1:
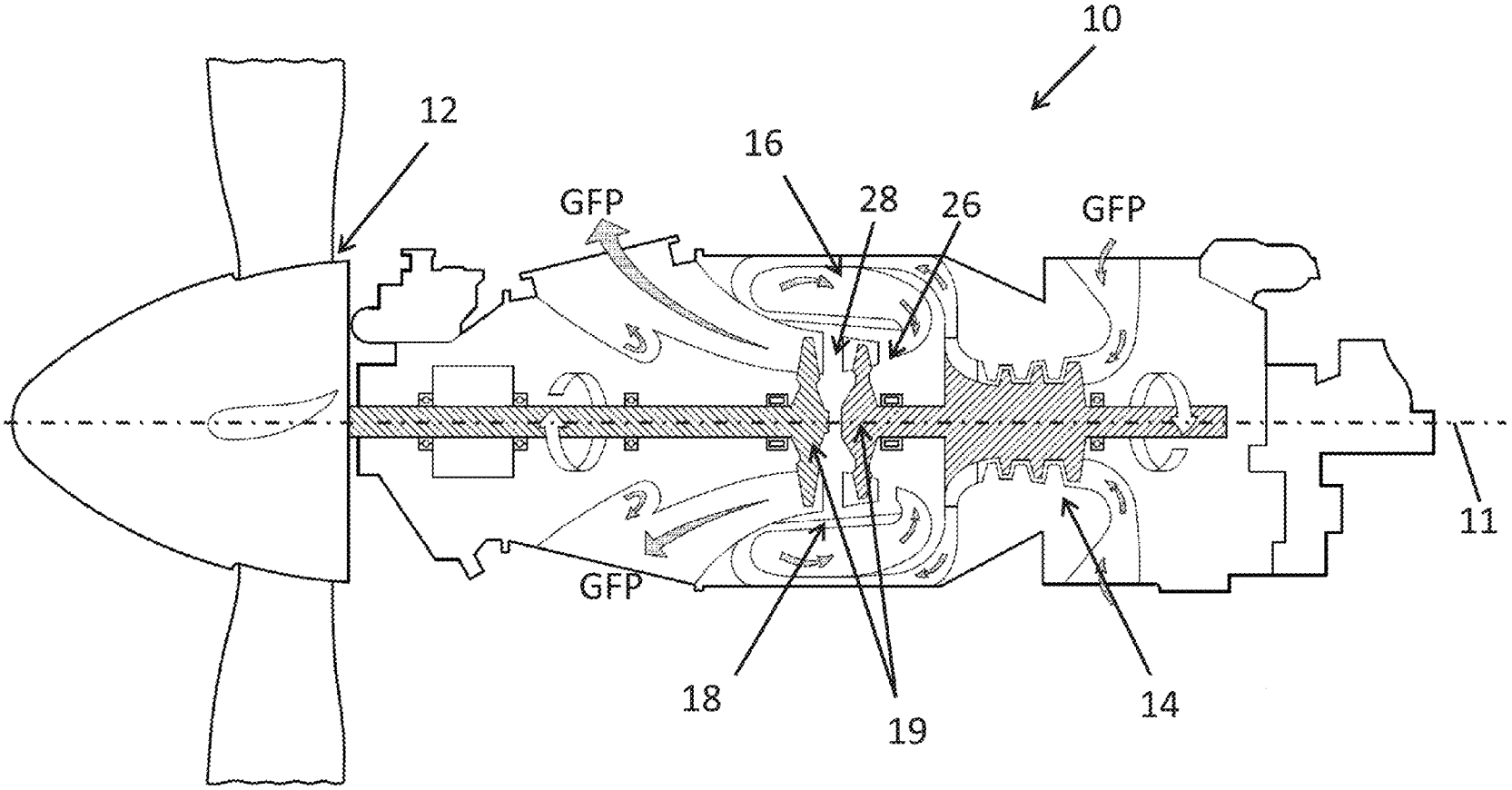
FIG. 1 is a schematic cross-sectional view of a gas turbine engine.

FIG. 1 illustrates a gas turbine engine 10 of a type preferably provided for use in subsonic flight, generally comprising in serial flow communication a compressor section 14 for drawing in and pressurizing the air, a combustor 16 in which the compressed air is mixed with fuel and ignited for generating an annular stream of hot combustion gases, and a turbine section 18 for extracting energy from the combustion gases. The turbine section 18 can consist of turbine rotors 19 and turbine vane assemblies 26,28. The rotation of one or more of turbine rotors 19 (e.g. those of the power turbine) can drive a propeller 12, while the rotation of separate one or more turbine rotors 19 (e.g. those of the compressor turbine) can drive compressor rotors of the compressor section 14. The gas flow path (GFP) is indicated generally by the arrows shown, and the gas turbine engine 10 has a center axis 11. Although the engine 10 is frequently described herein as being vertically oriented, it will be appreciated that the engine 10 can be oriented horizontally as well, or at any inclination to the horizontal, and is operable in all such positions.

As will be seen, the turbine section 18 of the gas turbine engine 10 has a first turbine assembly 26 and a second turbine assembly 28 which abut against one another, as well as an axial retaining ring 30 which secures the turbine vane assemblies 26,28 together, all of which will now be described in greater detail.

Figures 2A, 2B:
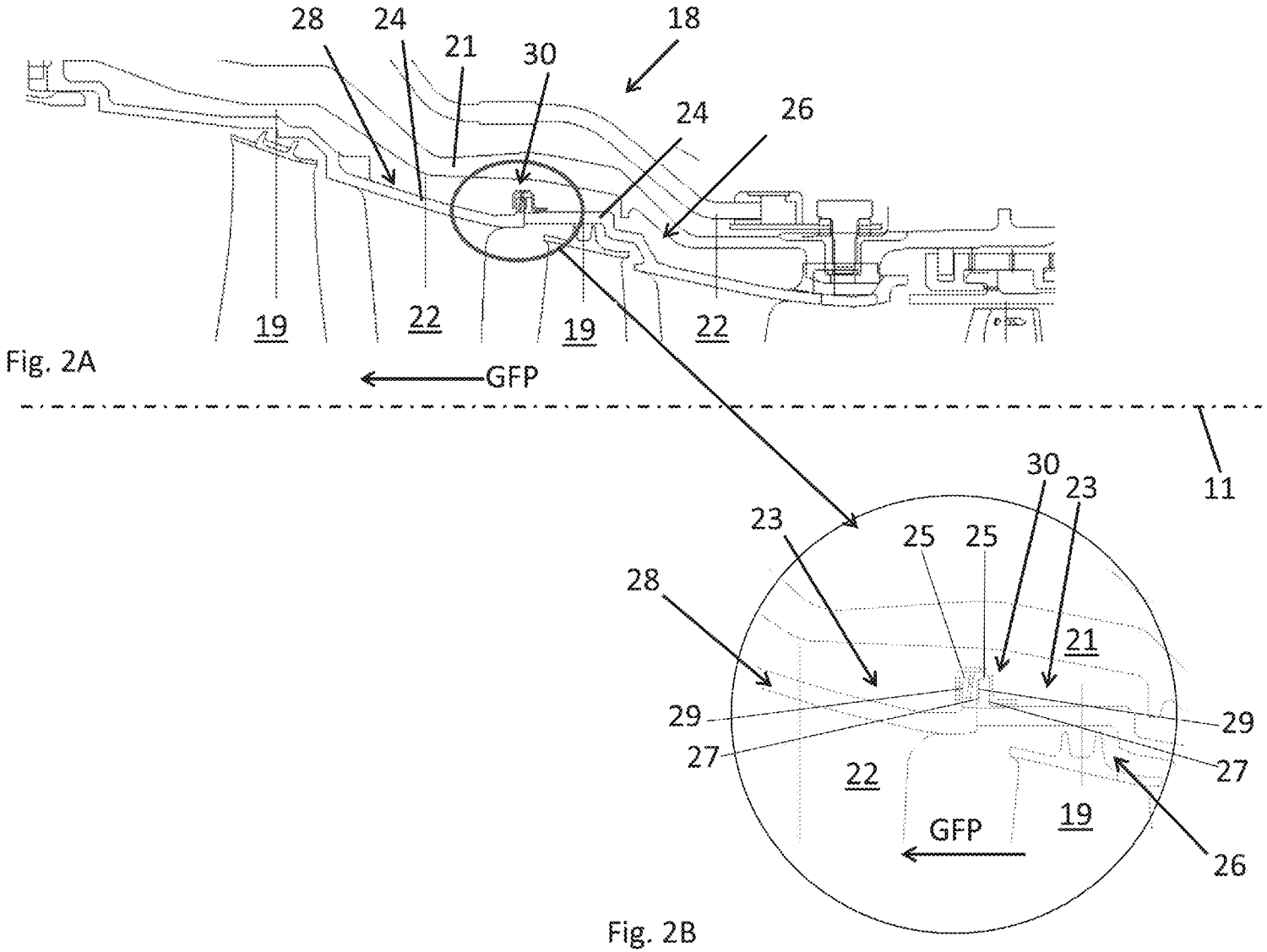
FIG. 2A is a schematic cross-sectional view of a turbine section of the gas turbine engine of FIG. 1, having an axial retaining ring according to an embodiment of the present disclosure.
FIG. 2B is a detailed cross-sectional view of a part of the turbine section of FIG. 2A.

Referring to FIGS. 2A and 2B, each of the first and second turbine vane assemblies 26,28 (or simply "turbine assemblies") includes a circumferential outer shroud 24 which houses within it one or more turbine vanes 22. The term "first" is used to denote the feature positioned furthest upstream in the gas flow path GFP, while the term "second" is used to denote the feature positioned furthest downstream in the gas flow path GFP. It will thus be appreciated that alternate terms can be used to designate these turbine assemblies 26,28. Turbine rotors 19 are located between adjacent turbine vanes 22 in the gas flow path GFP, and rotate with a central shaft about the center axis 11.

Each turbine assembly 26,28 is a stationary component, and is secured to the engine 10. In most instances, one of the ends of the outer shroud 24 of each turbine assembly 26,28 is mounted to a turbine support case (TSC) 21. The TSC 21 is a separate component from each turbine assembly 26,28, and is generally a circumferential body which encloses the core components of the turbine section 18. The other end of each outer shroud 24 is a mating end 23. The mating ends 23 of the turbine assemblies 26,28 are generally free ends until they are joined together with the retaining ring 30 of the present disclosure, thereby joining the first turbine assembly 26 to the second turbine assembly 28.

In contrast, conventional turbine assemblies are generally each mounted only to the TSC, and not to one another. Conventional retaining rings are generally used between the TSC and the first turbine assembly only, and apply a load against the first turbine assembly. During hot engine conditions, the turbine assemblies and the TSC both experience thermal expansion, with the turbine assemblies generally experiencing a greater amount of thermal expansion than the TSC. This difference in thermal expansion causes the retaining ring loading the first turbine assembly to undergo cyclical stresses, which can lead to permanent deformation of the retaining ring after only a few engine cycles. Once deformed, the function of the retaining ring is altered and may need to be replaced.

Another drawback associated with securing conventional turbine assemblies is that they may be designed to work only at an ordinary, horizontal attitude, and thus may not be suitable for engines that operate at a vertical attitude. For example, the first power turbine vane (PT1 vane) of at turbine vane assembly could possibly separate from the second power turbine vane (PT2 vane) when the gas turbine engine is vertically oriented and not operational, thereby creating a gap between the PT1 and PT2 vanes. When the engine start-up generates air pressure loads, the separated PT1 vane can push back across the gap and against the PT2 vane, which can be an undesirable cyclic movement because it can wear the turbine vane sealing faces prematurely.

In contrast, the retaining ring 30 disclosed herein, which joins the turbine assemblies 26,28 at their mating ends 23, may avoid such permanent deformation and cyclical loading because it joins two components (i.e. the turbine assemblies 26,28) which will experience a generally similar amount of thermal expansion, in the axial and/or radial direction. The retaining ring 30 may therefore retain its function through a greater number of engine cycles, thus reducing or eliminating the labour and expense involved in replacing it.

The mating end 23 of each turbine assembly 26,28 has a radially-extending mating flange 25. The mating flange 25 can be any arcuate rim, edge, or collar which projects radially away from the outer shroud 24 and extends around some or all of the periphery of the outer shroud 24 at the mating end 23. In most embodiments, the mating flange 25 extends around the entire periphery of the outer shroud 24, but it can also be multiple discrete or scalloped segments disposed at regular or irregular intervals along the circumferential periphery of the outer shroud 24, as further discussed below.

The shape of the mating flange 25 can vary. In the embodiments of FIGS. 2B and 6, the mating flange 25 is a collar protruding from the surface of the outer shroud 24 which is abutted against a corresponding mating flange 25 on the adjacent outer shroud 24 such that the two radially extending mating flanges 25 of the turbine assemblies 26,28 can be joined together. In the embodiment shown in FIG. 5, the mating flanges 125 are radially-extending protrusions of the turbine assemblies 26,28 which protrude radially away slightly from the outer shrouds 24, and are used to join both the turbine assemblies 26,28 together. Other configurations and shapes are possible for the mating flange 25 and are within the scope of the present disclosure. The mating flange 25 of one of the abutting turbine assemblies 26,28 can differ in shape from the corresponding mating flange 25 of the other turbine assembly, provided that together they allow for an abutting engagement between the turbine assemblies 26,28.

Returning to FIG. 2B, each of the mating flanges 25 has an upstream mating surface 27 and a downstream mating surface 29. The mating surfaces 27,29 can be any planar or curved surface. The downstream mating surface 29 of the first turbine assembly 28 abuts against the upstream mating surface 27 of the second turbine assembly 28, thereby abutting both turbine assemblies 26,28 together. The terms "upstream" and "downstream" refer to the orientation of the mating surfaces 27,29 with respect to the gas flow path GFP. Specifically, the upstream mating surface 27 is oriented to face toward the oncoming gas in the gas flow path GPF, whereas the downstream mating surface 29 is oriented to face away from the oncoming gas in the gas flow path GPF. As with the shape of the mating flanges 25, the shape of the upstream and downstream mating surfaces 27,29 can also vary and be dissimilar between the turbine assemblies 26,28.

Still referring FIGS. 2A to 2B, the turbine section 18 also has an axial retaining ring 30. The retaining ring 30 contacts both of the abutting turbine assembles 26,28 so as to axially secure them together, thereby reducing or preventing the formation of a gap between the adjacent turbine assemblies 26,28, particularly when the engine 10 is not operating and is oriented vertically. In so doing, the retaining ring 30 helps to reduce or eliminate any undesired cyclical movement between the turbine assemblies 26,28. Furthermore, in closing the axial gap between the adjacent turbine assemblies 26,28, the retaining ring helps to prevent the egress of hot combustion gases from within the turbine assemblies 26,28. For a vertically-oriented engine 10, the retaining ring 30 may only need to function during a cold engine condition (i.e. when the engine 10 is inactive or just starting up) because the gas loads generated by hot combustion gasses when the engine 10 is operational may be sufficient to maintain the first turbine assembly 26 in abutting contact with the second turbine assembly 28. The retaining ring 30 may be made of any suitable material, such as a Nickel alloy sheet metal.

The term "axially secures" refers to the ability of the retaining ring 30 to join the abutting turbine assemblies 26,28 together such that relative axial displacement (i.e. displacement along a direction parallel to the center axis 11 of the engine 10, regardless of the orientation of the engine 10) between the turbine assemblies 26,28 is reduced or prevented. Specifically, this relative axial displacement can be a relatively small vertical descent of the first turbine assembly 26 with respect to the fixed-in-place second turbine assembly 28 when the engine 10 is oriented vertically. In most embodiments, the retaining ring 30 is a continuous annular member extending around the entire periphery of the outer shrouds 24 of the turbine assemblies 26,28, but it can also be one or more separate arcuate members which collectively help to axially secure the turbine assemblies 26,28 together.

Figures 3A, 3B, 3C:
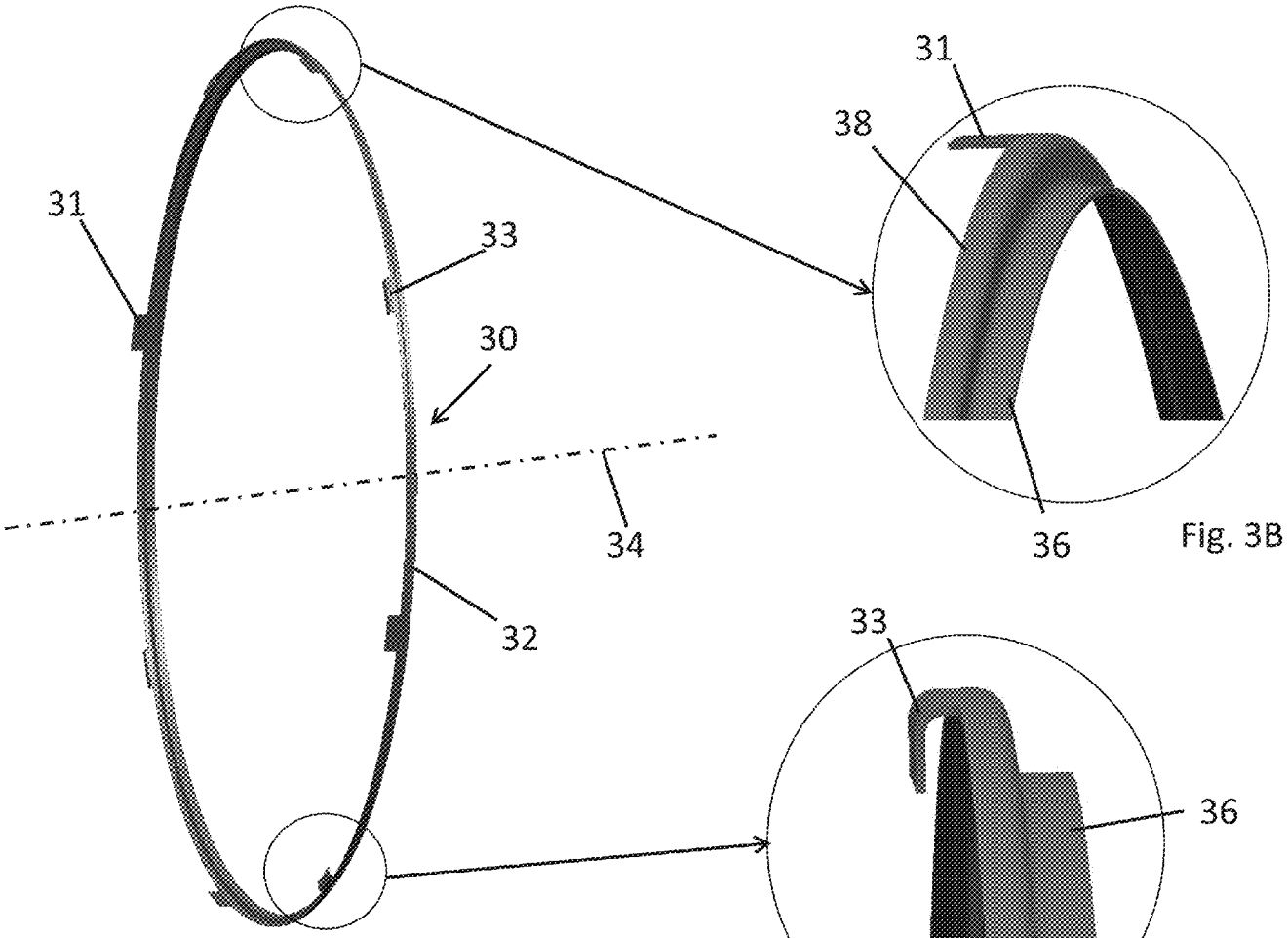
FIG. 3A is a perspective view of the axial retaining ring of FIG. 2A, shown with un-deformed anti-rotation tabs and connecting tabs.
FIG. 3B is a detailed perspective view of one of the un-deformed anti-rotation tabs of the axial retaining ring of FIG. 3A.
FIG. 3C is a detailed perspective view of one of the connecting tabs of the axial retaining ring of FIG. 3A.

FIGS. 3A to 3C show the embodiment of the retaining ring 30 of FIGS. 2A and 2B in greater detail. The retaining ring 30 has a body 32 which forms the corpus of the retaining ring 30 and is an annular member which can extend around some, or all, of the circumference of the outer shroud 24 of each turbine assembly 26,28. The body 32 defines a center body axis 34, which is parallel to the center axis 11 when the retaining ring 30 is mounted about the turbine assemblies 26,28. The body 32 has a width, which is measured between an upstream portion 36 of the body 32 and a downstream portion 38. The upstream and downstream portions 36,38 substantially conform to the profiles of outer surfaces of the mating flanges 25 against which they abut. The upstream portion 36 corresponds to the part of the body 32 which can be mounted to an upstream position on the first turbine assembly 26, such as its upstream mating surface 27. Similarly, the downstream portion 38 corresponds to the part of the body 32 which can be mounted to a downstream position on the second turbine assembly 28, such as its downstream mating surface 29.

The mounting of the upstream and downstream portions 36,38 to the turbine assemblies 26,28 can vary. For the embodiment of the retaining ring 30 shown in FIGS. 2A to 3C, the upstream portion 36 of the body 32 can loosely abut against the upstream mating surface 27 of the first turbine assembly 26 and components of the downstream portion 38, such as the tabs discussed below, can be used to secure the body 32 to the abutted mating flanges 25 of the turbine assemblies 26,28. For the embodiment of the retaining ring 130 shown in FIG. 5, either one or both of the upstream and downstream portions 136,138 can be brazed or welded to one or both of the mating flanges 25 of the turbine assemblies 26,28. For the embodiment of the retaining ring 230 shown in FIG. 6, both the upstream and downstream portions 236,238 can be clamped around the upstream mating surface 27 of the first turbine assembly 26 and the downstream mating surface 29 of the second turbine assembly 28, respectively. Various embodiments of the retaining ring 30 will now be described.

One embodiment is shown in FIGS. 3A to 3C. The downstream portion 38 of the body 32 of the retaining ring 30 can have one or more tabs which are circumferentially spaced apart along a circumference of the body 32. The tabs can be of at least two types: deformable anti-rotation tabs 31 and connecting tabs 33. As shown in FIG. 3B, the deformable anti-rotation tabs 31 extend or project away from the upstream portion 36 along a generally downstream direction which is substantially parallel to the center axis 11 of the engine 10 when the body 32 is mounted to the turbine assemblies 26,28, or to the center body axis 34 of the body 32. As will be further explained below, the anti-rotation tabs 31 can be bent or plastically deformed once the body 32 is in a suitable position on the turbine assemblies 26,28 into corresponding slots in the mating flange 25 of the second turbine assembly 28, thus helping the body 32 to avoid rotating about itself. As shown in FIG. 3C, the remaining tabs are connecting tabs 33 and are used to axially secure the body 32 of the retaining ring 30 to the mating flange 25 of the second turbine assembly 28. Each connecting tabs 33 extends or projects away from the upstream portion 36 along a generally downstream direction for a length which is substantially parallel to the center axis 11 or center body axis 34 before curving radially inward toward the axis 11,34. In so doing, each connecting tab 33 forms a hook which can engage with the downstream mating surface 29 of the second turbine assembly 28. The tabs 31,33 can be spaced apart equidistantly along the circumference of the body 32, and their position on the body 32 can alternate so that every second tab is an anti-rotation tab 31. This is exemplified in FIGS. 3A to 3C, where there are shown four anti-rotation tabs 31 and four connecting tabs 33. It will be appreciated that a quantity greater or less than the eight tabs discussed is also possible.

Figure 4A:
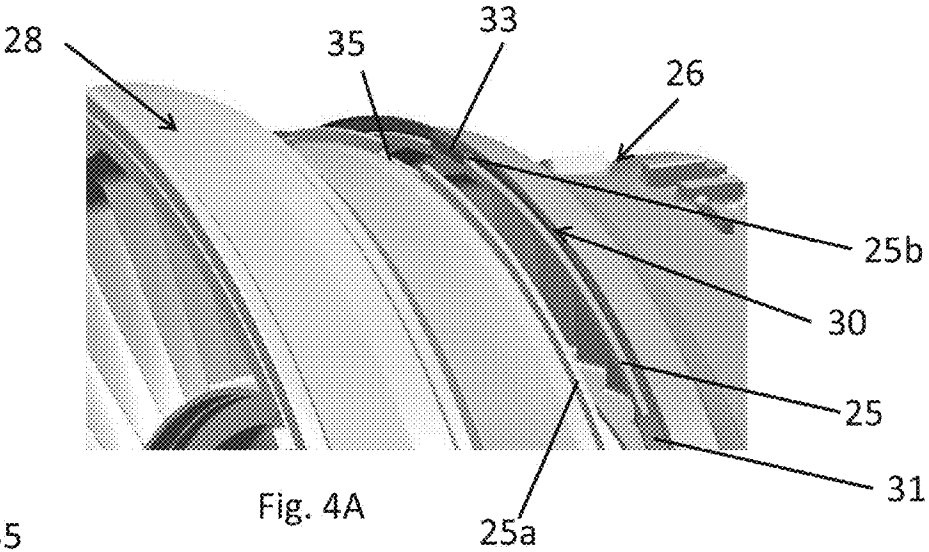
FIG. 4A is a perspective view of a first turbine vane assembly and a second turbine vane assembly, the axial retaining ring of FIG. 2A shown mounted to an outer shroud of the first turbine vane assembly.
Figure 4B:
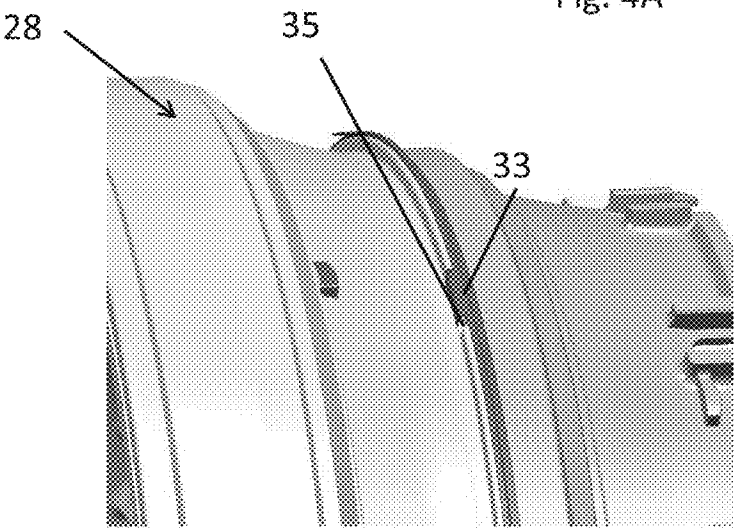
FIG. 4B is a perspective view of the first and second turbine vane assemblies of FIG. 4A abutted together.
Figure 4C:
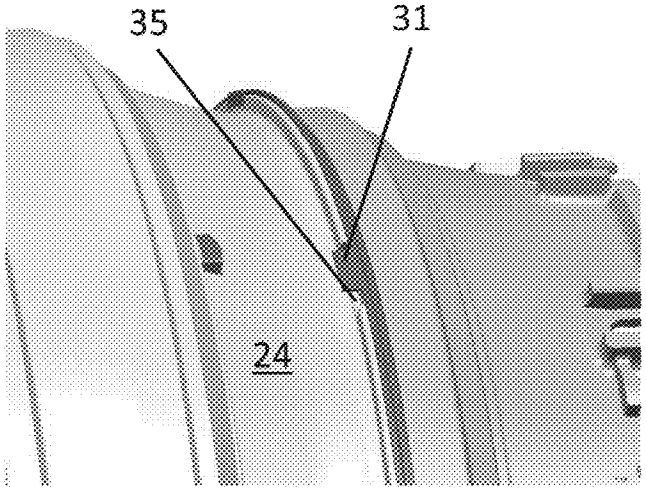
FIG. 4C is a perspective view of the first and second turbine vane assemblies of FIG. 4A abutted together and joined by the axial retaining ring of FIG. 2A, after the axial retaining ring has been rotated about the outer shroud of the first turbine vane assembly.

One possible mounting of the retaining ring 30 to the turbine assemblies 26,28 will now be described in reference to FIGS. 4A to 4C. In order to better receive the retaining ring 30, the second mating flange 25 of the second turbine assembly 28 may have a plurality of circumferentially-spaced slots 35, which create multiple spaced-apart local mating flanges 25*a* in between. Similarly, the first mating flange 25 of the first turbine assembly 26 may have multiple filler mating flanges 25*b*.

Figure 4D:
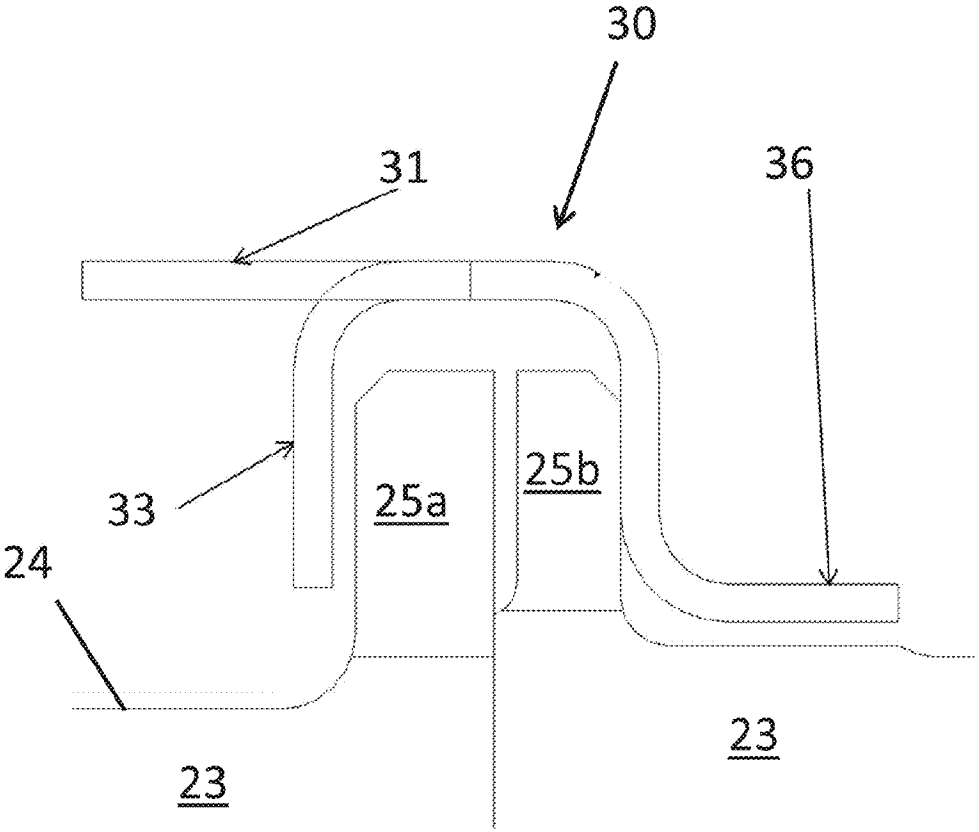
FIG. 4D is a cross-sectional view of the axial retaining ring of FIG. 2A, prior to anti-rotation tabs of the retaining ring being deformed into position.

The retaining ring 30 can be first placed on the first turbine assembly 26 so that its upstream portion 36 abuts against the mating flange 25. As shown in FIG. 4A, it can then be positioned or rotated about the center axis 11 until the connecting tabs 33 overlap the filler mating flanges 25*b* and the anti-rotation tabs 31 are disposed over the mating flange 25 of the first turbine assembly 26. The filler mating flanges 25*b* and the connecting tabs 33 can then be aligned with corresponding slots 35 of the second turbine assembly 28, and the turbine assemblies 26,28 can be abutted against one another at their mating ends 23. This places the filler mating flanges 25*b* and the connecting tabs 33 facing the slots 35, as shown in FIG. 4B. The retaining ring 30 can then be rotated along the abutted mating ends 23 about the center axis 11 until the anti-rotation tabs 31 are aligned with, and protrude into, the slots 35, as shown in FIG. 4C. In this position, the connecting tabs 33 abut against the downstream mating surfaces 29 of the local mating flanges 25*a*, thereby helping to clamp or axially secure the first turbine assembly 26 to the second turbine assembly 28. This position of the retaining ring 30 is also shown in FIG. 4D. As can be seen, the retaining ring 30 may be relatively loosely mounted about the mating flanges 25*a*,25*b*, which advantageously allows for applying a load to secure the turbine assemblies 26,28 together only during a cold engine condition. Thus, the retaining ring 30 can avoid always applying a compressive internal load to the mating flanges 25*a*,25*b*. Once in the position shown in FIGS. 4C and 4D, a bendable portion of the anti-rotation tabs 31 can be plastically bent or deformed within the slots 35 toward the outer shroud 24 of the second turbine assembly 28, thus preventing the retaining ring 30 from rotating about itself. The bent anti-rotation tabs 31 are shown in cross-section in FIGS. 2A and 2B.

Figure 5:
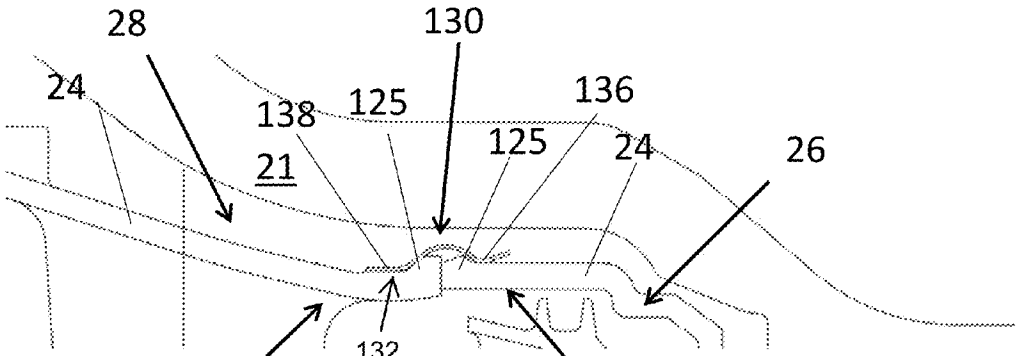
FIG. 5 is a schematic cross-sectional view of a turbine section of a gas turbine engine having an axial retaining ring, according to another embodiment of the present disclosure.
Figure 6:
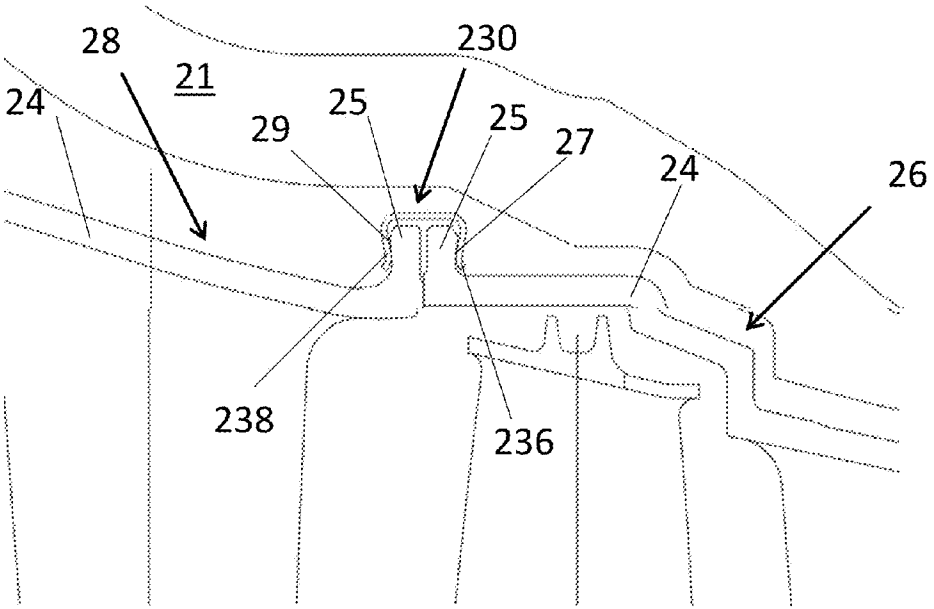
FIG. 6 is a schematic cross-sectional view of a turbine section of a gas turbine engine having an axial retaining ring, according to yet another embodiment of the present disclosure.

Another embodiment of the retaining ring 130 is shown in FIG. 5. The body 32 of the retaining ring 130 can be one or more separate arcuate body sections 132, each of which can be secured to both the turbine assemblies 26,28 at locations along their outer shrouds 24. FIG. 5 shows a cross-section of one of the body sections 132. For example, there can be four body sections 132 angularly offset from one another by about 90°. One or more of the upstream and downstream portions 136,138 of each body section 132 can be welded or brazed to one or both of the mating ends 23. Such a retaining ring 130 may weigh less than other retaining rings because of its division into body sections 132, but may also require a greater amount of time to install. The retaining ring 130 can thus axially secure the two turbine assemblies 26,28 together, and can further prevent the relative rotational movement of the turbine assemblies 26,28 with respect to one another. The retaining ring 130 is also not required to be stressed or apply a load during engine operation, which may increase its useable lifespan. Furthermore, the retaining ring 130 may occupy a lower amount of radial space between the outer shrouds 24 and the TSC 21.

Yet another embodiment of the retaining ring 230 is shown in FIG. 6. The body 32 can be substantially U-shaped in cross-section, and can be made of a resilient metal material. The body 32 can be composed of multiple body sections which can be friction fitted around the mating flanges 25 of the turbine assemblies 26,28. When mounted to both mating flanges 25, the body 32 can extend from the upstream portion 236 along the upstream mating surface 27 of the mating flange 25 of the first turbine assembly 26, over this mating flange 25 and the mating flange 25 of the second turbine assembly 28, and to the downstream portion 238 along the downstream mating surface 29 of this mating flange 25. The resilient material of this retaining ring 230 and its disposition on the mating flanges 25 allows it to exert an inwardly biased force against the surfaces of the mating flanges 25, thereby clamping the mating flanges 25 together. The retaining ring 230 can thus axially secure the two turbine assemblies 26,28 together, and can further prevent the relative rotational movement of the turbine assemblies 26,28 with respect to one another.

Other possible embodiments of the retaining ring 30, in addition to the ones described, are also within the scope of this disclosure. The selection of which retaining ring 30,130,230 to use for the turbine assemblies 26,28 can depend on the following non-limitative list of factors: the weight penalty, the available radial space between the outer shrouds 24 and the TSC 21, the amount of time available to mount the retaining ring 30,130,230, tolerance for possible thermal expansion of the turbine assemblies 26,28, and ease of installation.

Figure 7:
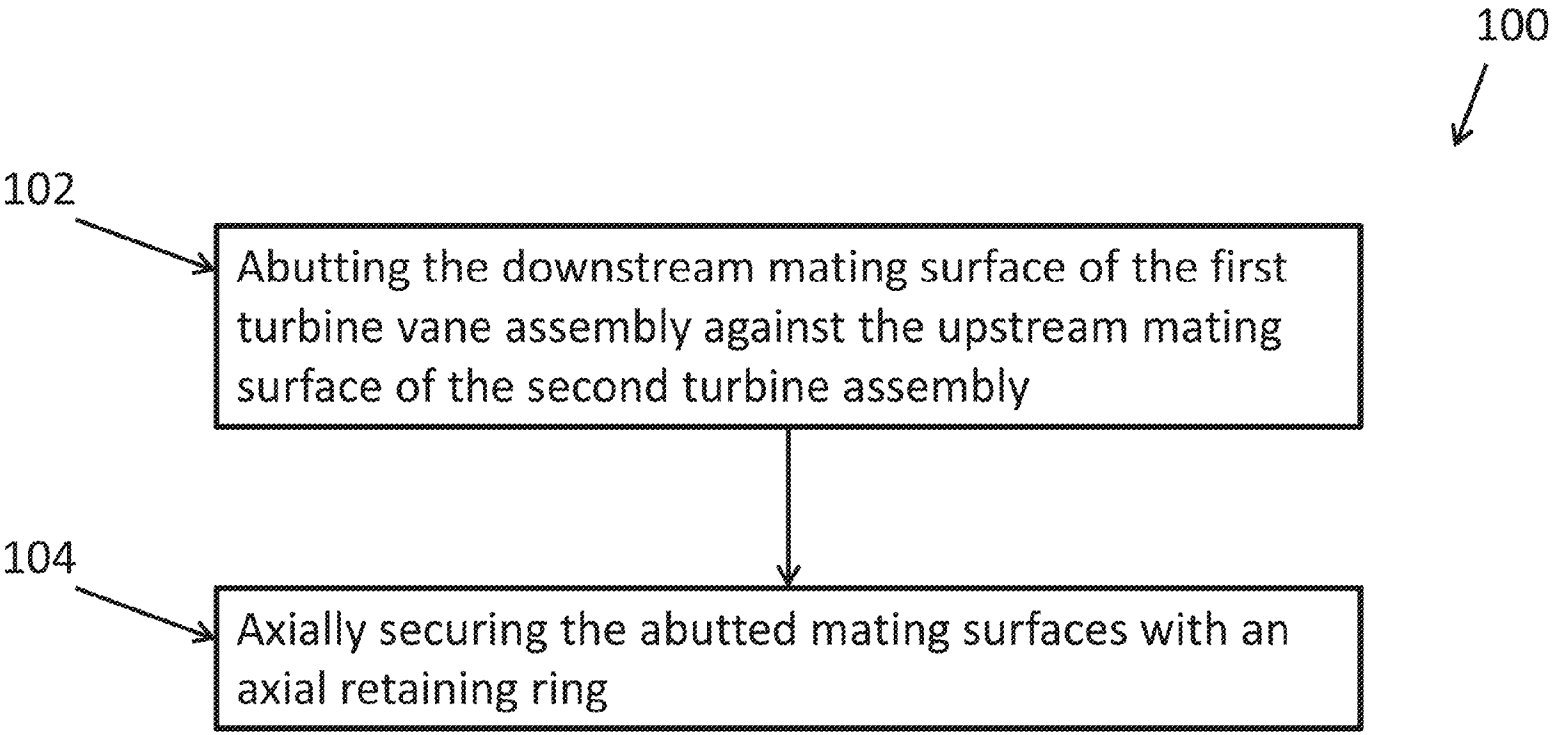
FIG. 7 is a flow chart showing a method for securing together adjacent first and second turbine vane assemblies of a gas turbine engine using the axial retaining ring as described herein.

There is also disclosed a method a method for securing together adjacent first and second turbine vane assemblies, shown as 100 in FIG. 7.

The method 100 includes abutting the downstream mating surface of the first turbine vane assembly against the upstream mating surface of the second turbine assembly, as described above, shown as 102 in FIG. 7. It will be appreciated that such an abutment can be reversed by having the second turbine vane assembly abutted against the first turbine vane assembly. As explained above, this abutment can involve applying a compressive force against the mating surfaces to clamp them together, such as with the U-shaped retaining ring described above which applies a spring-loading force. Alternatively, this abutment can include brazing or welding the axial retaining ring to at least one of the upstream mating surface of the first turbine vane assembly and the downstream mating surface of the second turbine vane assembly.

The method 100 also includes axially securing the abutted mating surfaces of with an axial retaining ring, shown as 104 in FIG. 7. In so doing, the axial retaining ring axially retains or secures the turbine assemblies together while allowing axial thermal growth or expansion therebetween. The retaining ring facilities this thermal expansion between the abutted turbine assemblies because the retaining ring joins two components (i.e. the mating flanges) which undergo a similar amount of thermal expansion in substantially the same direction (i.e. in the axial and radial directions), thus avoiding permanent deformation of the retaining ring.

The method 100 can also include aligning axially-extending anti-rotation tabs of the retaining ring with corresponding slots of the mating flange of the second turbine vane assembly. This can include rotating the retaining ring about 45° about the center axis until the anti-rotation tabs align with the slots. Once so aligned, the method 100 can include bending the bendable portions of the anti-rotation tabs into the corresponding slots, thereby helping to prevent the retaining ring from rotating about itself.

In light of the preceding, it can thus be appreciated that the joining together of the first and second turbine assemblies 26,28 by the retaining ring 30,130,230 helps to accommodate the radial and axial thermal expansion experienced by the turbine assemblies 26,28 during hot engine operation, while still maintaining the ability of the retaining ring to axially secure the turbine assemblies 26,28 together over many engine cycles. Furthermore, at least some of the retaining rings 30,130,230 do not exert a continuous pushing load against the corresponding upstream and downstream mating surfaces, and may be designed to apply a clamping load only when the engine 10 is in a cold engine condition. The retaining ring 30,130,230 can thus be unstressed during engine operation, when the gas loads force the turbine assemblies together. This can allow the retaining ring 30,130,230 to maintain its functionality over a longer number of engine cycles when compared to retaining rings which continually apply the pushing load.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A gas turbine engine having a center axis of rotation, the engine comprising:

first and second turbine vane assemblies having multiple turbine vanes within respective first and second circumferential outer shrouds, the first outer shroud having a first radially extending flange and the second outer shroud having a second radially extending flange, the radially extending first and second flanges each defining an upstream mating surface and a downstream mating surface relative to a direction of air flow through the engine in use, the downstream mating surface of the first flange mating with the upstream mating surface of the second flange; and an axial retaining ring axially retaining together the first and second flanges, the axial retaining ring having an annular body extending between an upstream portion of the body abutted against the upstream mating surface of the first flange and a downstream portion of the body abutted against the downstream mating surface of the second flange, the downstream portion having a plurality of tabs circumferentially spaced-apart on the body, at least some of the tabs being plastically deformable upon abutting the downstream portion of the body against the downstream mating surface of the second flange.

2. The turbine section of claim 1, wherein the first and second flanges extend circumferentially along a periphery of the first and second outer shrouds, respectively, the body being U-shaped and extending from the upstream portion along the upstream mating surface of the first flange, radially away from said upstream mating surface and over the first flange and the second flange, and to the downstream portion along the downstream mating surface of the second flange.

3. The turbine section of claim 1, wherein said at least some of the tabs tabs are deformable anti-rotation tabs extending away from the upstream portion in a direction parallel to the center axis, the remaining tabs being connecting tabs extending away from the upstream portion in a direction parallel to the center axis for a length then curving radially inwardly toward the center axis and abutting against the downstream mating surface of the second flange.

4. The turbine section of claim 3, wherein the second flange has a plurality of circumferentially-spaced arcuate slots, each anti-rotation tab aligning with a corresponding slot and having a bendable portion deforming into the corresponding slot.

5. The turbine section of claim 3, wherein the tabs are circumferentially spaced-apart equidistantly on the body.

6. The turbine section of claim 3, wherein every second tab is an anti-rotation tab.

7. The turbine section of claim 1, wherein the body has a plurality of separate arcuate body sections, at least one of the upstream or downstream portions of each body section being brazed or welded to a corresponding end of the first or second outer shrouds.

8. An axial retaining ring for axially retaining together first and second turbine vane assemblies of a gas turbine engine having multiple turbine vanes within respective first and second circumferential outer shrouds, the first shroud having a first radially extending flange and a second shroud having a second radially extending flange, the radially extending first and second flanges each defining an upstream mating surface and a downstream mating surface relative to a direction of air flow through the engine in use, the axial retaining ring comprising: an annular body defining a center body axis and extending between an upstream portion of the body abutted against the upstream mating surface of the first flange and a downstream portion of the body abutted against the downstream mating surface of the second flange upon the body mounting about abutting downstream and upstream mating surfaces of the first and second flanges, respectively, the downstream portion having a plurality of tabs circumferentially spaced-apart on the body, at least some of the tabs being plastically deformable upon abutting the downstream portion of the body against the downstream mating surface of the second flange.

9. The axial retaining ring of claim 8, wherein the body is U-shaped, and extends in use from the upstream portion along the upstream mating surface of the first flange, over the first flange and the second flange, and to the downstream portion along the downstream mating surface of the second flange.

10. The axial retaining ring of claim 8, wherein said at least some of the tabs are deformable anti-rotation tabs extending away from the upstream portion in a direction parallel to the center body axis, the remaining tabs being connecting tabs extending away from the upstream portion in a direction parallel to the center body axis for a length then curving radially inwardly toward the center body axis.

11. The axial retaining ring of claim 10, wherein the tabs are circumferentially spaced-apart equidistantly on the body.

12. The axial retaining ring of claim 10, wherein every second tab is an anti-rotation tab.

13. The axial retaining ring of claim 10, wherein each connecting tab has a connecting portion defined by a radially-inwardly curved portion of said connecting tab, each connecting portion in use mating with the downstream mating surface of the second flange.

14. The axial retaining ring of claim 8, wherein the body has a plurality of separate arcuate body sections, at least one of the upstream or downstream portions of each body section being brazed or welded to a corresponding end of the first or second outer shrouds upon the body sections mounting about the abutting downstream and upstream mating surfaces of the first and second flanges, respectively.

15. A method for securing together adjacent first and second turbine vane assemblies of a gas turbine engine having a center axis, each turbine vane assembly having a radially extending, arcuate mating flange defining an upstream mating surface and a downstream mating surface, the method comprising:

abutting the downstream mating surface of the first turbine vane assembly against the upstream mating surface of the second turbine assembly;

axially securing the abutted mating surfaces of the first and second turbine vane assemblies with an axial retaining ring, the axial retaining ring axially retaining the mating flanges of the first and second turbine vane assemblies together while allowing thermal growth therebetween; and plastically deforming some of a plurality of tabs circumferentially spaced-apart on the axial retaining ring.

16. The method of claim 15, wherein said some of the plurality of tabs include axially-extending anti-rotation tabs, the method further comprising aligning the axially-extending anti-rotation tabs of the axial retaining ring with corresponding slots of the mating flange of the second turbine vane assembly.

17. The method of claim 16, wherein aligning the anti-rotation tabs includes rotating the axial retaining ring about the center axis.

18. The method of claim 16, further comprising bending the anti-rotation tabs into the corresponding slots.

19. The method of claim 15, further comprising brazing or welding at least part of the axial retaining ring to at least one of the upstream mating surface of the first turbine vane assembly and the downstream mating surface of the second turbine vane assembly.

20. The method of claim 15, wherein abutting the mating surfaces includes applying a compressive force to clamp the mating ends together.

* * * * *